US007954405B2

(12) United States Patent
Kling

(10) Patent No.: US 7,954,405 B2
(45) Date of Patent: Jun. 7, 2011

(54) HANDS-FREE PAPER TOWEL DISPENSER AND DISPENSING SYSTEM

(75) Inventor: Robert Kling, Skene (SE)

(73) Assignee: SCA Hygiene Products AB, Gothenburg (SE)

( * ) Notice: Subject to any disclaimer, the term of this patent is extended or adjusted under 35 U.S.C. 154(b) by 559 days.

(21) Appl. No.: 11/806,741

(22) Filed: Jun. 4, 2007

(65) Prior Publication Data

US 2007/0236110 A1 Oct. 11, 2007

Related U.S. Application Data

(63) Continuation of application No. PCT/SE2004/002032, filed on Dec. 29, 2004.

(51) Int. Cl.
*B65H 19/00* (2006.01)

(52) U.S. Cl. ..... 83/346; 83/649; 225/106; 242/419.4; 242/526

(58) Field of Classification Search ..... 312/34.4; 83/649, 650, 346; 225/106, 32; 242/419.5, 242/419.8, 419.9, 419.4, 421.8
See application file for complete search history.

(56) References Cited

U.S. PATENT DOCUMENTS 804,306 A * 11/1905 Fonda ..... 226/100
893,582 A * 7/1908 Hess ..... 83/322
1,717,747 A * 6/1929 Uttz, Sr. ..... 83/610
2,686,018 A * 8/1954 Courtney ..... 242/151
2,809,082 A * 10/1957 Marcuse ..... 226/186
2,887,247 A * 5/1959 Williams, Jr. ..... 221/25
3,935,978 A * 2/1976 Arp et al. ..... 225/15
4,516,711 A * 5/1985 Barege ..... 225/20
4,592,669 A * 6/1986 Lohse et al. ..... 400/621
4,832,786 A * 5/1989 Meschi ..... 156/506
4,846,412 A * 7/1989 Morand ..... 242/560.1
4,952,432 A 8/1990 Wolde
5,205,454 A * 4/1993 Schutz et al. ..... 225/1
5,207,633 A 5/1993 Granger
6,007,168 A 12/1999 Gaide
6,131,587 A 10/2000 Chardack et al.
6,892,620 B2 * 5/2005 Kapiloff ..... 83/649
7,624,664 B2 * 12/2009 Morris et al. ..... 83/648
2007/0152010 A1 * 7/2007 Denen et al. ..... 225/10
* cited by examiner

*Primary Examiner* — Kenneth E. Peterson
(74) *Attorney, Agent, or Firm* — Young & Thompson

(57) ABSTRACT

A dispensing unit includes an outer front wall, two outer side walls, a housing for holding a pile of a continuous length of accordion-like folded web of towels of tissue paper or non-woven including bundles, the outer front wall having an access opening to the pile, a dispensing opening for the web of towels and a feeding mechanism including a member for controlling the dispensing of the web of towels, a drive unit and a braking arrangement for the web of towels. A unit of consumable articles includes the pile of bundles with connecting elements therebetween, which are inserted through the access opening into the housing in the dispensing unit and added to the bottom of the pile. The web of towels is dispensed from the upper part of the pile by a feeding mechanism, which positions the web of towels in a starting mode in the dispensing opening.

35 Claims, 6 Drawing Sheets

HANDS-FREE PAPER TOWEL DISPENSER AND DISPENSING SYSTEM

TECHNICAL FIELD

The invention relates to a hands-free paper towel dispenser and a hands-free paper towel dispensing system.

BACKGROUND OF THE INVENTION

Automatic touch free dispensers or hands-free dispensers for paper towels of tissue paper or nonwoven are known on the market. The hands-free dispensers are electronically maneuvered, they store and advance the paper towel with different kinds of control devices, sensors and power sources available on the market, they are usually battery driven. Without touching the dispenser, i.e. hands-free, the user can get a paper towel that is feeded automatically by the electronic dispenser. Dispensers like this are commonly used in public lavatories for dispensing paper towels to users. The most common type of a powered, hands-free dispenser is a roll dispenser with different kind of sensors used to initiate the mechanisms for advancing the towel such that the next sheet is presented to the user. Some examples of different electronic hands-free roll towel dispensers are disclosed in U.S. Pat. No. 4,666,099, U.S. Pat. No. 4,796,825, U.S. Pat. No. 4,826,262, U.S. Pat. No. 5,452,832, U.S. Pat. No. 5,772,291, U.S. Pat. No. 6,412,655, WO 99/59457 and WO 00/63100. There is a wide range of various sensors used in the dispensers, such as IR sensors, radio frequency disruption sensors, capacity sensors, motion or light detectors, mechanical detectors, photoelectric cell or proximity detectors and so forth.

An internal source of energy within the dispenser is usually used, such as batteries. The rolls are often heavy and there is a friction and resistance for unrolling the paper, especially when the roll is accelerated there is a high demand of energy from the battery. Consequently there is a need for a strong paper in order to withstand the force necessary to start a full heavy roll to rotate. A strong paper usually has drawbacks in that the softness of the paper is low. The life time of the batteries are often short due to the heavy rolls, which require much power to rotate and to accelerate. In addition the hands-free dispensers for rolled paper towels demand a rather large space in the hand washing area due to the relatively big volume of the heavy paper rolls.

It is desirable that an electronic hands-free dispenser has a nice design, that it is not so bulky and space demanding and that it easily will fit into the room where it will be utilized by the users. Especially at public places such as washrooms, it is very useful to have smaller dispensers. Further, the maintenance should be kept at a low level, as well as the cost for the dispenser. Lower battery cost would also be an advantage. Also, the refill process for an attendant should be as easy as possible. These are problems often frequented with the prior hands-free dispensers. Looking into the desired properties for the towels, when you need to have a strong paper, the paper has a tendency to also be harsher and not so soft. It would be preferable for the users if a more soft paper could be used, which can be somewhat difficult since the electronic hands-free towel dispensers on the market today operate with hard wound rolls of paper.

An object of the invention according to the present claims is to provide solutions in order to reduce the above-mentioned problems and drawbacks. A further object is to provide an electronic hands-free dispenser that is less space demanding, has a nice flat design, that is cheaper and easier to use, maintain and refill and that the desired properties of the paper towels can be more freely chosen.

SUMMARY OF THE INVENTION

According to one embodiment of the invention, these objects are achieved by means of a hands-free paper towel dispenser with a dispensing unit comprising an outer front wall, two outer side walls and a housing for holding a pile of a continuous length of accordion-like folded web of towels of tissue paper or nonwoven comprising bundles of a continuous length of accordion-like folded web of towels of tissue paper or nonwoven. The pile comprises connecting means between the bundles and the outer front wall comprises an access opening to the pile of the web of towels, through which the bundles of a continuous accordion-like folded web of towels are inserted into said housing and added to the bottom of the pile. The dispensing unit further comprises a feeding mechanism comprising a member for controlling the dispensing of the web of towels from the upper part of the pile, a drive unit and a braking arrangement for the web of towels, the feeding mechanism positions the web of towels in a starting mode in the dispensing opening. The paper towel is unfolded during dispensing to a flat form when it is dispensed through the dispensing opening. Other objects and advantages of the present invention will become apparent to those skilled in the art from the following description and practice of the invention.

The member for controlling the dispensing of the web of towels comprises a microprocessor. The member for controlling the dispensing of the web of towels may also comprise a sensor unit that detects the last towels of the web of towels. The drive unit comprises preferably a battery, a motor and drive rollers.

The dispensing unit also comprises a starting sensor, which senses the presence of a user, and activates the feeding mechanism, which automatically will initiate the dispensing of the web of towels to a hands-free position. The starting sensor preferably has an operating range of approximately 30 cm from its location. The starting sensor is usually located in close proximity to the dispensing opening. When the hand of a user approaches the dispensing opening, the web of towels will thus automatically be presented in the hands-free position and thereby ready to use. The length of the web of towels presented in the hands-free position is preferably from about 15 to about 50 cm. It is also possible to make the feeding mechanism to feed forward a paper towel by a button or the like that could be pressed by the user.

The user can then grab the dispensed web of towels and easily detach a towel from the continuous web of towels either by tearing it off directly from the web by using a tearing edge. Alternatively, the dispensing unit comprises a cutting unit that will perforate or precut the web in order to facilitate for the user to detach a towel from the web of towels. The perforation or precutting can be introduced to the web of towels by a cutting knife located at the feeding mechanism. According to another embodiment such a cutting knife for the creation of a perforation line can of course also be situated in any other suitable part of the feeding mechanisms, e.g. close to the braking arrangement or in proximity of the dispensing opening. If the web does not have any perforation, cutting or precutting unit, a tearing edge is preferably located close to the dispensing opening.

According to one embodiment of the invention the width of the side walls of the dispensing unit used is preferably not more than 10 cm and the accordion-like folded towels preferably have a panel width of not more than 10 cm. The panel width is the distance between two consecutive folds, parallel with the feeding direction of the web of towels. Since the panel width is not more then 10 cm, preferably not more than 9 cm, it is possible to achieve a flat design of the hands-free dispenser. The space required is therefore less and the hands-free dispenser can be kept in close proximity to the wall to which the dispenser is attached.

According to an embodiment of the invention the starting mode of the web of towels is kept in the dispensing opening by the braking arrangement. The feeding mechanism allows the position of the web of towels in the dispensing opening to remain unchanged in the starting mode during refill. This is especially preferable since it eliminates the need for an attendant to feed a leading edge of the continuous length of accordion-like folded web of towels into the braking arrangement and out through the dispensing opening.

The starting mode is the position after a user has taken a towel and before a new towel is automatically fed. The term starting mode means that the web of towels is positioned close to the dispensing opening but that at least the main part of the towel is still protected by the dispenser mostly due to hygienic reasons. The web of towels is thereby protected as far as possible before it is being used.

According to a further embodiment of the invention, the member for controlling the dispensing of the web of towels from the upper part of the pile does not allow the last towels of the web of towels to be dispensed such that the position of the web of towels are kept in the starting mode in the dispensing opening. The starting sensor is not able to activate the feeding mechanism and consequently the last towels of the web of towels are not allowed to be dispensed and the position in the starting mode will be kept. One preferred embodiment to achieve this is that the member for controlling the dispensing of the web of towels comprises a sensor unit comprising at least one sensor located at the side or sides of the pile of web of towels. Said sensor unit detects the last towels of the web of towels and when the sensor unit detects that there is no paper, the starting sensor is not able to activate the feeding mechanism. The sensor unit allows the member for controlling the dispensing of the web of towels to be in an operative mode as long as the web of towels are detected by the sensor unit. There are many advantages with this, one is that the dispenser is easy to maintain and above all to refill since there is no need for the web of towels to be led through the feeding mechanism, drive rolls etc etc. All the attendant needs to do is to add the extra bundle to the pile of bundles and see to that the connecting means at the top of the bundle is properly attached to the bottom of the pile and thereby the dispenser disposes of a continuous length of accordion-like folded web of towels with all the advantages this will have.

According to an embodiment the sensor unit transmits a signal that can be used to measure an interruption of the continuous web of towels passing through from the pile of the web of towels to the feeding mechanism. The sensor unit is placed at a distance from the feeding mechanism that is big enough such that the remaining last web of towels easily can be connected to the connecting means on the next bundle of web of towels that will be inserted into the housing.

The function of the sensors and/or detectors used may be optical as well as mechanical, any function may be used, capacity, IR, radio frequency, motion, proximity or light sensors or detectors, photoelectric cells etc etc may be used and is considered to be enclosed. The sensor and detector used may be of any kind available in the market and known to the public.

According to an embodiment of the invention there is also an extra indicator, such as an indicator lamp, that will be activated when the sensor unit signals that the dispenser is empty as the interruption of the continuous web of towels passing through from the pile of the web of towels to the feeding mechanism is measured and the web of towels kept in the starting mode. The indicator may be situated on the outside of the dispenser where it easily can be seen.

When the access opening is opened, the automatically feeding mechanism goes in a non operative mode by being disconnected or blocked. This can be achieved by a sensor or a switch in the access opening. Alternately, the feeding mechanism receives signals to block any feeding forward of the web of towels when the sensor unit measures an interruption of the continuous web of towels. According to a further embodiment the sensor unit may be reset when the access opening is opened and then closed again. When the sensor unit is reset, the feeding mechanism will also in consequence be reset such that when the access opening has been opened and thereby closed. The web of towels can thus not be feeded forward when the access opening is opened.

A further embodiment to the invention discloses the use of a release paper that reveals the connecting means between the bundles, said connecting means comprises glue or an adhesive or pressure sensitive tape. The bundles can be wrapped with a protective paper around the bundles. The release paper may be the same as or a part of the protective paper. The release paper and a possible protective paper could also be two separate papers. The main purposes for the release paper is to protect the connecting means and its adhesive properties, however it could thus also be used to protect the bundles as such from dirt or to keep the bundles in an intact shape. One of the preferred embodiments of the invention comprises the connecting means with glued or adhesive areas protected by release paper, which may be part of the normal bundle wrapping.

In a preferred embodiment according to the invention the placement of the feeding mechanism is situated in vertical alignment with the pile of web of towels. This would mean that the hands-free dispenser does not extend outside the with of the outer side walls nor outside the panel width of the pile of a continuous length of accordion-like folded web of towels of tissue paper or nonwoven, which is advantageous in order to be able to keep a flat design.

DETAILED DESCRIPTION OF EMBODIMENTS OF THE INVENTION

Figure 1:
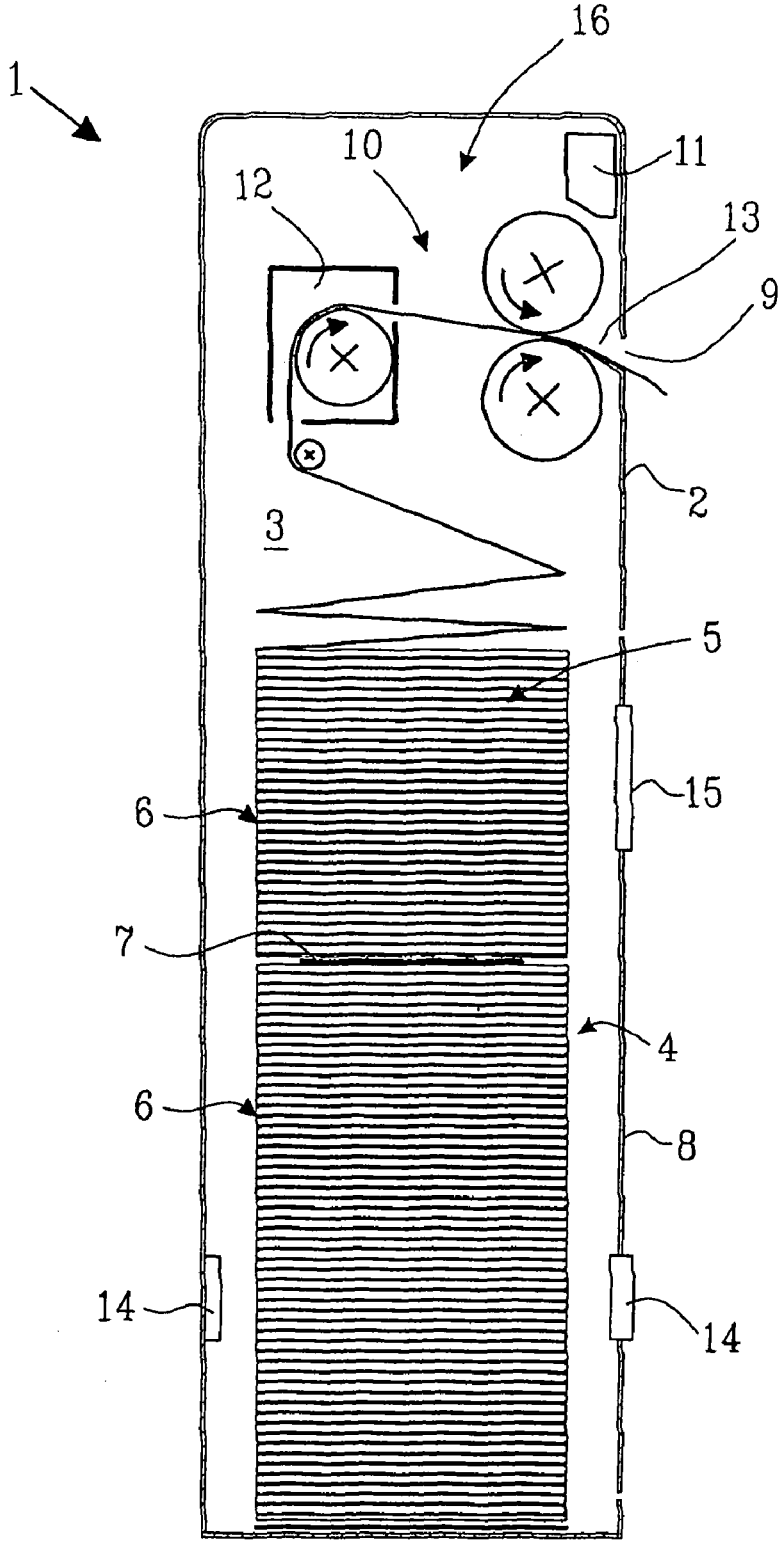
FIG. 1 is a sectional view of the hands-free paper towel dispenser with the dispensing opening situated above the pile of a continuous length of accordion-like folded web of towels of tissue paper or nonwoven.

The term hands-free dispenser means that the dispenser is an electronical automatic touch free dispenser. A touch free dispenser is usually an electronical dispenser that will leave a part of the web of towels either close to the dispensing opening or outside the dispenser ready to be used by the users. An automatic touch free dispenser, such as a hands-free dispenser, have some sort of automatically fed towels, i.e. without touching the dispenser the user can get the feeding forward of a towel from the hands-free paper towel dispenser that is electronically motor driven. The paper towels can be fed automatically in different ways. The user can then grab the towel and pull or tear of the given amount of paper.

The term hands-free position is when the web of towels has been fed forward and automatically dispensed by the feeding mechanisms and the web of towels is thus now sticking out through the dispensing opening and ready to be pulled, teared or cut by the user. There is no need for the user to get the paper since it is already in the hands-free position and so to say ready to be used. According to an embodiment of the invention the outer part of the area close to the dispensing opening may be transparent so that the web of towels in the starting mode is easily seen by the user. This would encourage the user to direct his hand close to the dispensing opening, which would be detected by the starting sensor, which in turn would initiate the automatically dispensing of the web of towels to the hands-free position. Other solutions would be to have a part of the web of towels to be dispensed sticking out somewhat in order to direct the hands of the user to the dispensing opening. Still another solution is to provide the outside of the dispenser with information of where the user should direct his hand in order to get a towel.

The web of towels may according to an embodiment of the invention further be divided into separate towels of tissue paper or nonwoven by any cutting or tearing action, perforations in the web of towels may further enhance this process. A cutting member such as a cutting knife could be placed within the dispenser. Also tearing the paper web could be done internally within the dispenser by a rotating knife. The tearing of the web of towels into individual towels can also be done completely or partly manually by the user. In a preferred embodiment of the invention there is a tearing edge close to the dispensing opening.

The dispensing of the web of towels is performed from the upper part of the pile and the hands-free dispensers are therefore so called top feeded. The dispensing opening could be placed above the pile of the web of towels or below the pile of the web of towels, however the dispensing would still be called top feeded since the web of towels are dispensed from the top of the pile. Some advantages with the top fed system is that the pile will have a continuous length of web of towels and that the dispensing is easy and also that it will require as little energy from the power supply unit as possible.

One of the advantages with a top fed hands-free dispenser is that it is easy to feed the web of towels into a dispensing mode and to dispense the web of towels since the only weight to be lifted is the weight of the upper part of the continuous web of towels. A top fed hands-free dispenser, such as according to the invention as claimed, has a capacity for very long continuous length of accordion-like folded web of towels of tissue paper or nonwoven. According to one of the embodiments of the invention the dispenser may even be placed on the floor and reaching up to any desired level, thus containing a large storage capacity that will even more reduce the maintenance such as the refilling process. Thus, in order to secure a great amount of paper in the claimed dispenser, the height of the dispenser can be all the way up from the floor, if one so wishes, and up to a convenient level for paper tearing or cutting. This will not require large space in the hand washing area due to the nice, flat design. Not only is the dispenser given an attractive and nice appearing look but also the choice of where to place it is very flexible. Further, due to the easy dispensing the battery will endure longer and therefore there is less attendance also to the maintenance of the batteries of the hands-free dispenser.

According to one embodiment of the invention a hands-free paper towel dispensing system comprises a unit of consumable articles and a dispensing unit. The unit of consumable articles comprises a pile of a continuous length of accordion-like folded web of towels of tissue paper or nonwoven material web comprising bundles of a continuous length of accordion-like folded web of towels of tissue paper or nonwoven material web, and there are connecting means between the bundles. A dispensing unit comprises an outer front wall comprising an access opening and two outer side walls, a housing for holding said pile, a dispensing opening for the web of towels, a feeding mechanism comprising a member for controlling the dispensing of the web of towels from the upper part of the pile, a drive unit and a braking arrangement for the web of towels. The unit of consumable articles is located within the dispensing unit and inserted through the access opening into the housing for holding the unit of consumable articles as the bundles of a continuous length of accordion-like folded web of towels of tissue paper or nonwoven material web is added to the bottom of the pile. The unit of consumable articles is further connected by the web of towels from the upper part of the pile to the dispensing unit via the braking arrangement and out through the dispensing opening, whereas the feeding mechanism positions the web of towels in a starting mode in the dispensing opening. The consumable articles comprising towels of tissue paper or nonwoven material web are used and dispensed through the hands-free paper towel dispensing system.

According to an embodiment of the invention the braking arrangement comprises a pair of feeding rolls that are secured such that they will not be able to go in backward direction. Rolls where the web of towels passes a single straight nip can be used as well as so called S-rolls where the web of towels are S-fed through the rolls. However, these rolls have also a mechanical barrier that can be unlocked and thereby enables these feeding rolls to go backwards. This can be useful for maintenance or cleaning reasons. However, when the sensor unit has signaled that the dispenser is empty, then these feeding rolls are in a locked position both for forward as well as backward direction. According to a further embodiment these feeding rolls are also locked if the feeding is being forced forward faster than the automatically dispensing of the web of towels admitts. This reduces the risk of a break in the web of towels within the dispenser if a user would try to pull and force out a towel faster than it can be dispensed.

During refill of the dispenser it is preferable that the feeding mechanism is deconnected or blocked in a non operative mode such that the drive function in the feeding mechanism does not work. One way of many to achieve this is to have a detector communicating with a circuit in the member for controlling the dispensing of the web of towels and the microprocessor will not order the engine to drive the drive rollers.

Figure 3:
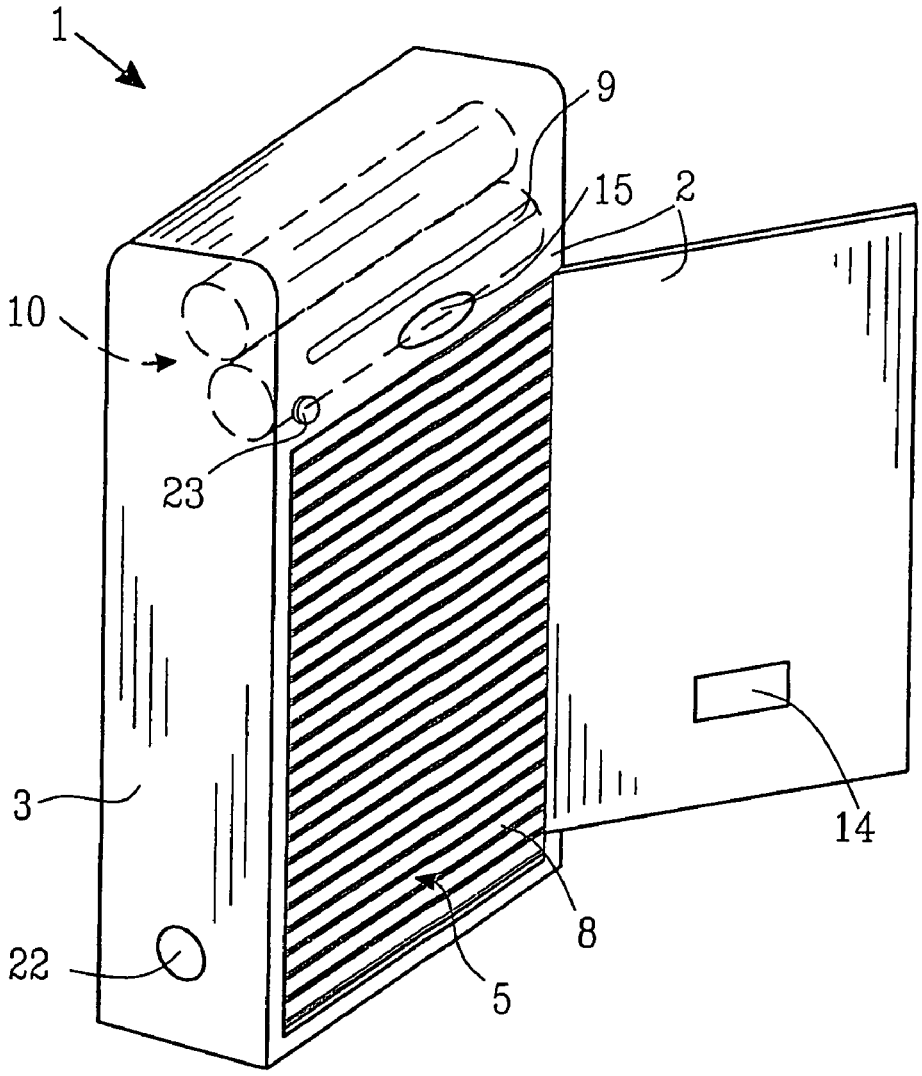
FIG. 3 is a side view of the hands-free paper towel dispenser with the access opening open and the dispensing opening situated above the pile of a continuous length of accordion-like folded web of towels of tissue paper or nonwoven.

The refill of the dispenser have to be done when the dispenser is empty, it is however preferred that the refill is done before the dispenser is empty. In an embodiment according to the invention there is a second sensor unit below the first sensor unit which measures and detects that the pile of bundles is at a low level and will thereby send signals to a warning system, such as a lamp. The second sensor unit is located at the side or sides of the pile of web of towels below the sensor unit that measures the last web of towels. The second sensor unit may be a motion detector that will sense and signal when the web of towels are being removed and from the pile of web of towels and thereby in motion; in contradiction to when the web of towels are motionless as they are lying still in the pile of the continuous length of accordion-like folded web of towels. The second sensor unit may also be located at the bottom of the pile of bundles of the continuous length of accordion-like folded web of towels and measure the weight of the pile and thus signal when there is only a small amount of the bundles left in the pile due to the lesser weight. Alternatively, as shown in FIG. 3 a sensor 22 located on the side walls can be used to measure a steady signal, when the height of the pile of web of towels is lowered, this sensor would only occasionally measure the presence of the web of towels and could then indicate that there is a low level. The warning system is preferably placed on the outside where it is easily detected. It may be a low level indicator lamp 23, the lamp could for instance then be blinking when there is a low level and having a steady light when the dispenser is empty. However, there are a number of possible alternatives that may be used and that the skilled man in the art would use.

Figure 2:
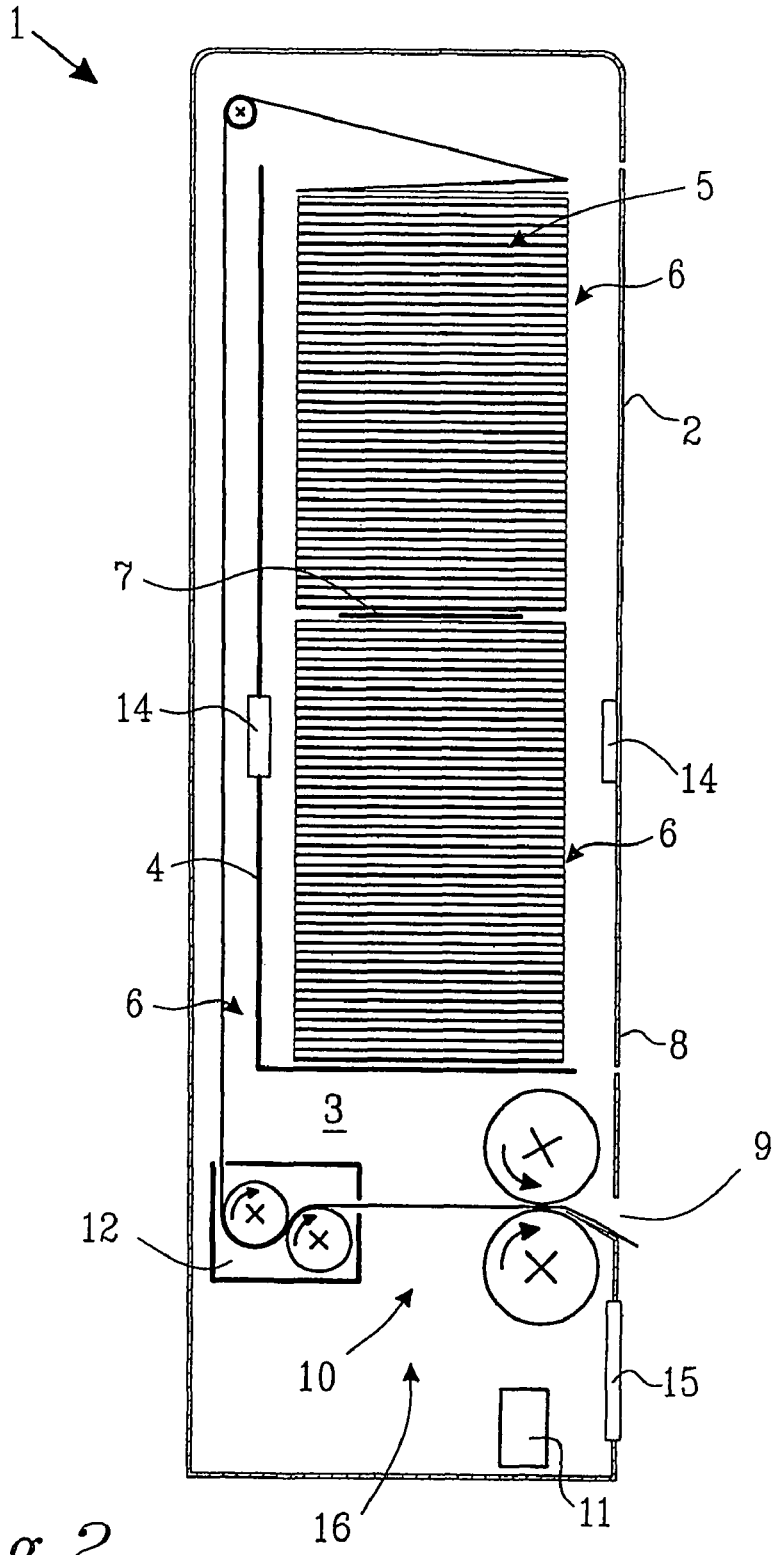
FIG. 2 is a sectional view of the hands-free paper towel dispenser with the dispensing opening situated below the pile of a continuous length of accordion-like folded web of towels of tissue paper or nonwoven.

FIGS. 1, 2 and 3 show a hands-free paper towel dispenser with a dispensing unit 1 according to an embodiment of the invention. The dispensing unit 1 has an outer front wall 2, two outer side walls 3 and a housing 4. The front of the dispensing unit comprises a front wall 2, side walls 3, and possibly a top and a bottom of the dispensing unit. The housing 4 is situated within the dispenser behind the outer front wall 2 and is intended for holding a pile 5 of a continuous length of accordion-like folded web of towels of tissue paper or nonwoven comprising bundles 6 of a continuous length of accordion-like folded web of towels of tissue paper or nonwoven. The bundles 6 comprise connecting means 7 between the bundles 6. The connecting means 7 comprise glue or an adhesive or pressure sensitive tape. A release paper protects and reveals the connecting means 7 and could also be used as a bundle wrapping for each bundle 6.

The pile 5 is held by the housing 4, the housing 4 comprises a bottom plate and at least a substantially vertical wall behind the pile 5. The substantially vertical wall behind the pile 5 may either be the back wall of the dispenser such as can be seen for example in FIG. 1 or it may also be an inner back wall within the dispenser such as for example can be seen in FIG. 2. The housing 4 is horizontal, but can also slope forwards or rearwards so that the pile 5 will rest against a front or rear support when so desired. The outer front wall 2 comprises an access opening 8 by which the pile 5 of bundles 6 of the web of towels can be accessed and through which the bundles 6 of the continuous length of accordion-like folded web of towels are inserted into the housing 4. The bundles 6 are added to the bottom of the pile 5, the pile is manually lifted by the attendant and is added to the pile and connected to the lowest bundle in the pile 5 with help of the connecting means 7. If there is a release paper, the release paper and/or protective paper is removed from the bundle or bundles before it is added to the bottom of the pile 5. FIG. 3 shows a hands-free paper towel dispenser with a dispensing unit 1 according to an embodiment of the invention from a side view which also shows the access opening 8 clearly.

The web of towels are dispensed in a flat form via a dispensing opening 9, a feeding mechanism 10 comprises a member for controlling the dispensing 11, a drive unit 16, and also a braking arrangement 12 for the web of towels. The dispensing starts from the upper part of the pile 5 and the web of towels is connected to the dispensing unit. From the upper part of the pile 5, the web continuous to the braking arrangement 12 and out through the dispensing opening 9. FIGS. 1 and 2 shows two different embodiments of the invention where both are top feeded, however the dispensing opening 9 as well as the feeding mechanism 10 is located at the top of the dispenser 1 in FIG. 1 and at the bottom of the dispenser 1 in FIG. 2. Parts of the feeding mechanism 10, such as for instance the member for controlling the dispensing 11 of the web, could also be situated above the pile of the web 5 even though the dispensing opening 9 is situated below the pile of the web 5.

The braking arrangement 12 are secured so that they do not enable the web of towels to go backwards during normal operation. The braking arrangement also positions the web of towels in a starting mode 13 in the dispensing opening 9. A tearing edge or a cutting member is situated in close proximity of the dispensing opening. A portion of the web could preferably be left projecting a little bit from the dispensing opening 9 after the part of the web feeded out has been torn or cut off. Alternatively, the web of towels in the starting mode 13 could be entirely inside the dispenser and the dispensing unit 1, in these cases it is preferred either to have some part above the dispensing opening 9 somewhat transparent such that at least a part of the web of towels can be seen from the outside of the dispenser. If not any part of the web of towels can be seen from the outside of the dispenser, the location of where the web of towels are dispensed can of course be indicated in any other suitable manner comprising text, signs, figures etc.

The member for controlling the dispensing 11 of the web of towels comprises a sensor unit 14, which in turn comprises at least one sensor located at the side or sides of the pile 5 of the web of towels. The member for controlling the dispensing 11 of the web of towels also comprises a microprocessor. The microprocessor receives signals, the signals are then distributed and transmitted to other units within the feeding mechanism 10. The sensor unit 14 detects the last towel of the web of towels. An interruption of the continuous web of towels that are passing through from the pile 5 of the web of towels and further to the feeding mechanism 10 is detected and measured by the sensor unit 14. The sensor unit 14 may transmit a signal to detect the interruption.

A starting sensor 15 can be seen in FIGS. 1, 2 and 3 close to the dispensing opening. The starting sensor 15 senses the present of a user and will activate the feeding mechanism 10, which automatically will initiate the dispensing of the web of towels to a hands-free position. The hands-free position will present the web of towels outside the dispenser as it is sticking out from the dispensing opening 9 and ready to be pulled, torn or cut off from the web by the user. Even if the web of towels has been pre-cut inside the dispenser, a small part of the towel is still connected to the web of towels due to practical and hygiene reasons. The panel width of the towels is less than the width of the side walls 3. Preferably the width of the side walls 3 is not more than 10 cm, however, this can of course be freely chosen.

The dispenser 1 could be in a non operative mode when necessary. If the web of towels would be situated above the sensor unit 14, as when the web of towels is about to be finished and the ending of the web of towel is hanging freely above the sensor unit 14, then the dispenser 1 would go into a non operative mode. The sensor unit 14 would not get any signal that there is paper present and thereby the feeding mechanism 10 can not feed forward the paper web even if the starting sensor 15 is activated by a user. The braking arrangement 12 would also lock the web of towels such that the web of towels can not be pulled backwards. If the access opening 8 in the front wall 2 would be opened, the function would be the same, i.e. that the feeding mechanism is blocked. Either a part of the sensor unit 14 is situated at the front wall or there might also be a switch at the access opening 8 that will cut the signal to the microprocessor.

Another situation when it would be good if the dispenser 1 is in a non operative mode is when the feeding mechanism 10 has fed out the web of towels in the hands-free position such that the web of towels is fed out from the dispensing opening 9 in a predetermined amount of length. The risk is now that the starting sensor 15 would get another signal to continue to feed forward more paper towels. To avoid this problem, the member of controlling the dispensing 11 could be set to require a certain time interval, e.g. 3-5 seconds, where the starting sensor 15 would be in a non operative mode before another feeding forward cycle could be affected. There are of course a number of different options of how the dispenser 1 could be set in a non operative mode.

Figure 4:
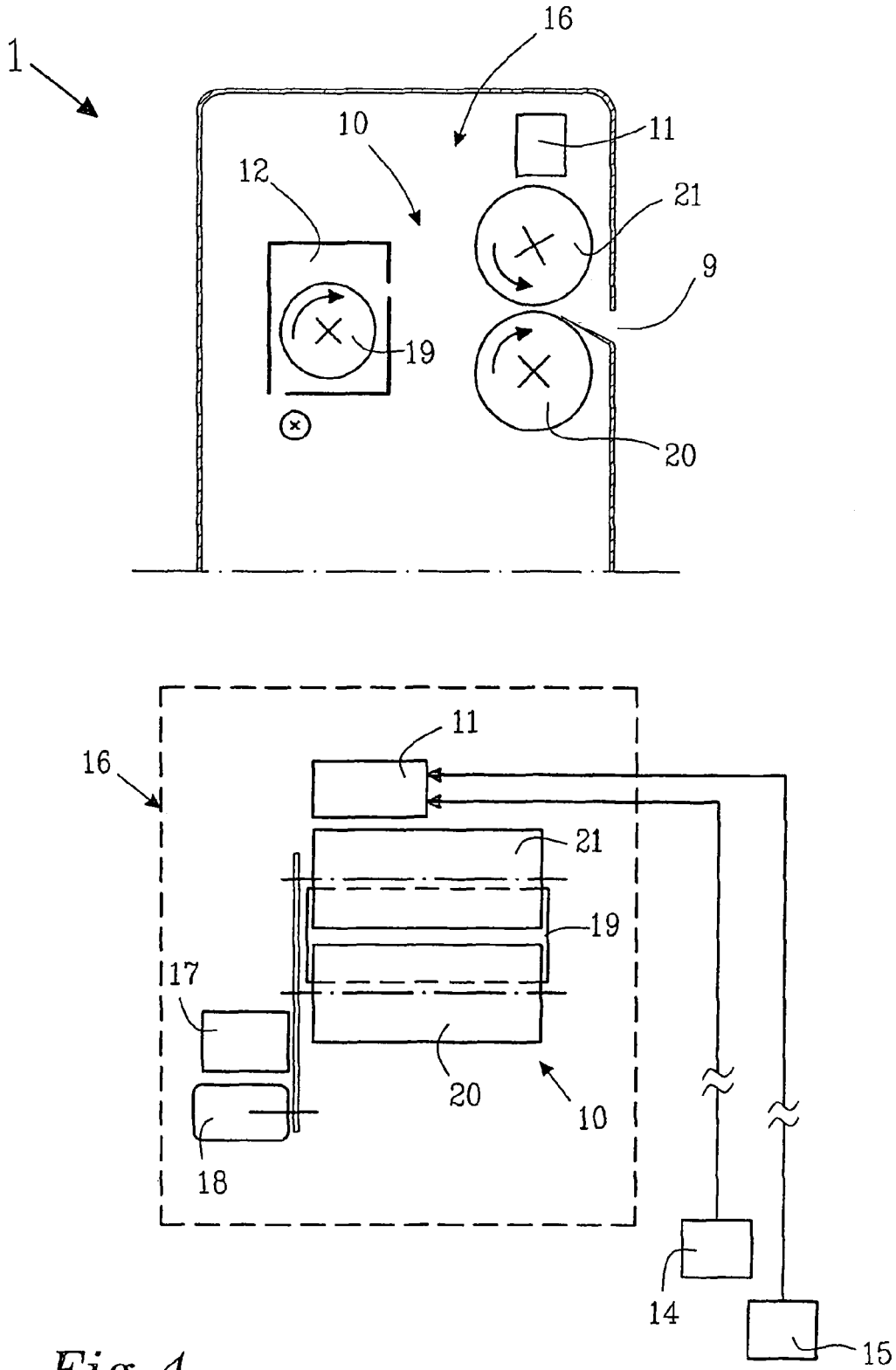
FIG. 4 shows a general and also a more detailed view of the drive unit.

FIG. 4 shows a schematic view of the drive unit 16 and the feeding mechanism 10, which comprises the member for controlling the dispensing 11, the braking arrangement 12 and the drive unit 16. According to an embodiment of the invention the drive unit comprises a battery 17 used as a power source, a motor 18, and drive rollers 19, 20 and 21. The battery 17 could of course be placed anywhere within the dispenser, even outside the dispenser or the dispensing unit 1 could be an option. According to the embodiments shown in FIGS. 1 and 2, the drive unit 16 is placed either at the top of the dispenser or at the bottom of the dispenser. The member for controlling the dispensing 11 comprising the microprocessor receives signals from the sensor unit 14 and also from the starting sensor 15, this is represented by the arrows shown in FIG. 4.

When the dispenser 1 is in an operative mode and provided that there is a web of towels is present at the sensor unit 14, the microprocessor will get the signals necessary to activate the feeding mechanism 10 as the user activates the starting sensor 15. A pre-set amount of paper is then fed forward by the motor 18 that drives the drive rollers 19, 20 and 21. A suitable engine type would for example be a stepping motor, but of course there are many other options as well. The length of the paper towel to be fed forward is preferably chosen such that the feeding each time would be enough to ensure the user to dry their hands in a sufficient manner. Depending on the absorption of the paper towel the length could advantageously be varied from about 15 to about 50 cm, especially since there might be a delay between two consecutive feedings. It would thus further be an advantage for the user to receive an amount of paper such that the user does not feel that he needs to activate the feeding mechanism directly once again.

Figure 5:
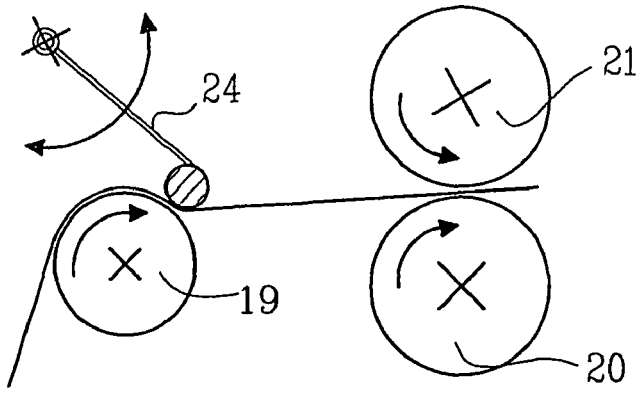
FIG. 5 shows an embodiment of the braking arrangement.

It is clear to the skilled man in the art that any braking arrangement could be used in the hands-free paper towel dispenser. One of the purposes with the braking arrangement is to prevent the web of towels to be drawn backwards out of the feeding mechanism, for instance when the dispenser is refilled by new bundles of web of towels. FIG. 5 shows an embodiment of the invention with an example of a mechanical braking arrangement 12 with a nip for the paper web with a rubber covered roll 19. According to an embodiment of the invention seen in FIG. 5, there might be a rod 24 which locks the paper towel against the rubber roll 19 when pulling backwards. When the paper is fed through the feeding mechanism 10 in a direction towards the dispensing opening, the web tension lifts the rod 24 slightly and the paper is then released from locking. Of course, for instance an electric, electromagnetic, influenced brake would also be suitable to use or other mechanical locking arrangements such as feathers in grooves or the like in the endings of the rollers might also be used, etc etc.

Figure 6:
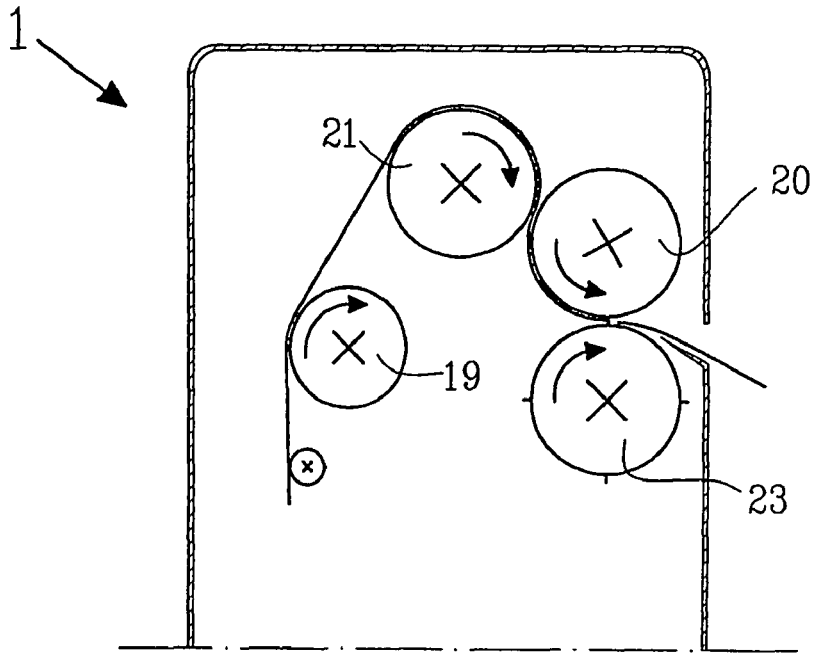
FIGS. 6 and 7 show some embodiments of a cutting or perforation arrangement.
Figure 7:
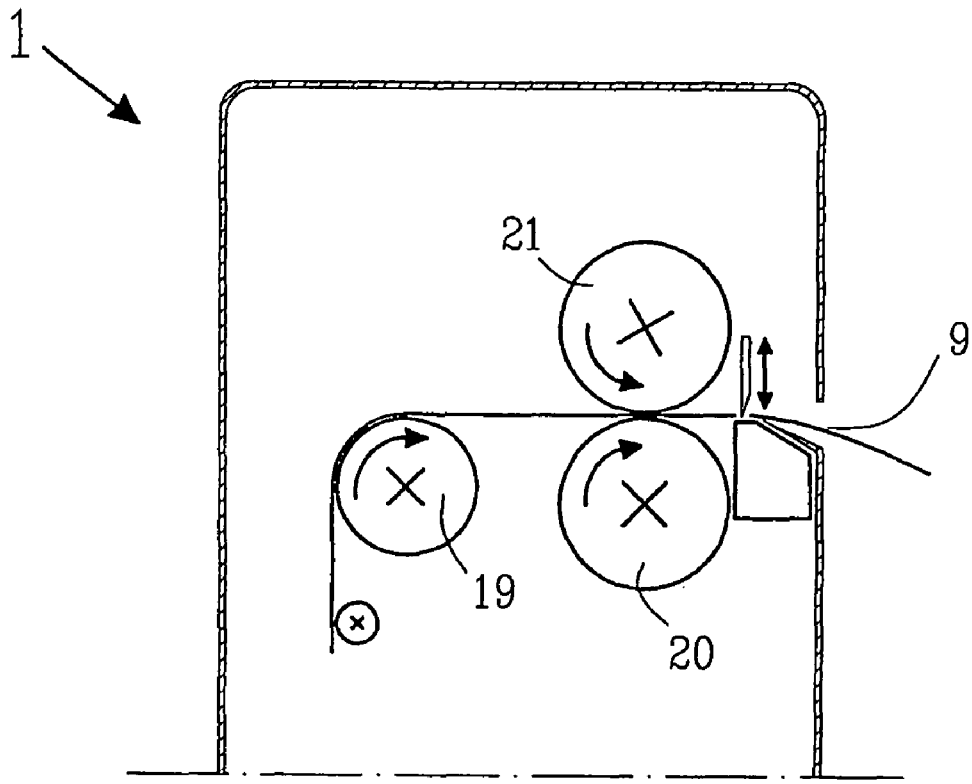

FIGS. 6 and 7 show two different possible cutting arrangements according to an embodiment of the invention. In FIG. 6 the cutting or perforation is integrated in a roll 23, which acts more as a support roll than a drive roller. The roll 23 works against the second drive roll 21. The drive rollers 20 and 21 are arranged in a S-configuration. This arrangement is advantageous if it, due to the dispensing length of the paper towel, would be necessary for the roll 23 to roll slower than the drive rollers 20 and 21. The cutting or perforation could alternatively be integrated in the drive roller 20, which would render the support roll 23 optional. If the cutting or perforation would be integrated in the drive roller 20, the dimension of the drive roll needs to be chosen with regard to the desired dispensing length. In FIG. 7 the cutting is made by the user by tearing the dispensed paper towel against a tearing edge. The invention in by no means limited to these cutting arrangements, the person skilled in the art would freely choose any available cutting arrangement that may be suitable for the invention.

The invention also comprises any evidently suitable method or technical details that would involve the claimed hands-free paper towel dispenser and paper towel dispensing system. The invention is also capable of other embodiments than those displayed and also of being carried out in various ways.

The invention claimed is:

1. A hands-free paper towel dispenser, comprising:

a pile (5) of a continuous length of accordion-like folded web of towels of tissue paper or nonwoven comprising bundles (6), said bundles (6) comprising means for connecting (7) between the bundles (6), a dispensing unit (1) having an outer front wall (2), two outer side walls (3), a top, and a housing (4) for holding the pile (5) of the web of towels, said outer front wall (2) comprising i) an access opening (8) to the pile (5) of the web of towels, through which access opening (8) the bundles (6) of a continuous accordion-like folded web of towels are inserted into said housing (4) and added to the bottom of the pile (5) of the web of towels and ii) a dispensing opening (9) for the web of towels; and a feeding mechanism (10) comprising i) a member for controlling, by sending signals, the dispensing (11) of the web of towels from the upper part of the pile (5) the member for controlling including a microprocessor and at least one sensor unit, ii) a drive unit (16) located at a first position of the web of towels, the drive unit (16) including two drive rollers (20, 21), and iii) a braking arrangement (12) for the web of towels, the braking arrangement (12) located at a second position of the web, upstream of the first position of the web of towels, the feeding mechanism (10) being arranged to automatically position the web of towels in a starting mode (13) in the dispensing opening (9) the braking arrangement being configured so as not to allow the web of towels to go backward during normal operation, the braking arrangement including a nip for the paper web with a rubber covered roll (19) and a rod (24) to lock the web of towels against the rubber covered roll (19) when pulling backwards the rod being pivotable about an axis spaced from the rod, such that the rod presses against a downstream side of the rubber covered roll.

2. The hands-free paper towel dispenser according to claim 1, wherein the feeding mechanism (10) is situated in vertical alignment with the pile of web of towels.

3. The hands-free paper towel dispenser according to claim 2, wherein the width of the side walls (3) used is not more than 10 cm.

4. The hands-free paper towel dispenser according to claim 2, wherein the feeding mechanism (10) allows the position (13) of the web of towels in the dispensing opening (9) to remain unchanged in the starting mode (13) during refill.

5. The hands-free paper towel dispenser according to claim 2, wherein the feeding mechanism (10) is arranged to go in a non operative mode when the access opening (8) is opened.

6. The hands-free paper towel dispenser according to claim 2, wherein the member for controlling the dispensing (11) of the web of towels from the upper part of the pile (5) does not allow the last towels of the web of towels to be dispensed.

7. The hands-free paper towel dispenser according to claim 6, wherein the member for controlling the dispensing (11) of the web of towels comprises a first sensor unit (14) having at least one sensor located at the side or sides of the pile (5) of web of towels, said first sensor unit (14) being arranged to allow the member for controlling the dispensing (11) to be in an operative mode as long as the web of towels are detected by the first sensor unit (14).

8. The hands-free paper towel dispenser according to claim 7, wherein the first sensor unit (14) is arranged to transmit a signal that can be used to measure an interruption of the continuous web of towels passing through from the pile (5) of the web of towels to the feeding mechanism (10).

9. The hands-free paper towel dispenser according to claim 7, further comprising an indicator arranged to be activated when the first sensor unit (14) signals that the dispenser is empty as the interruption of the continuous web of towels passing through from the pile (5) of the web of towels to the feeding mechanism (10) is measured.

10. The hands-free paper towel dispenser according to claim 7, further comprising a second sensor unit (22) below the first sensor unit (14), which is arranged to measure and detect that the pile (5) of the web of towels is at a low level and will thereby send signals to a warning system, such as a lamp.

11. The hands-free paper towel dispenser according to claim 2, wherein the at least one sensor unit comprises a starting sensor (15) arranged to sense the presence of a user, and activate the feeding mechanism (10), which automatically will initiate the dispensing of the web of towels to a hands-free position.

12. The hands-free paper towel dispenser according to claim 11, wherein the starting sensor (15) has an operating range of not more than approximately 30 cm.

13. The hands-free paper towel dispenser according to claim 2, wherein the length of the web of towels presented in the hands-free position is preferably from about 15 to about 50 cm.

14. The hands-free paper towel dispenser according to claim 1, wherein the feeding mechanism (10) includes a tearing edge configured to tear a dispensed paper towel.

15. The hands-free paper towel dispenser according to claim 1, wherein the at least one sensor unit comprises at least one sensor at a side or sides of the pile (5) of the web of towels, the at least one sensor unit being configured to sense a last towel of the web of towels or an interruption of the web of towels.

16. The hands-free paper towel dispenser according to claim 1, wherein the feeding mechanism (10) includes a support roll (23), the support roll (23) including a cutting or perforation integrated into the support roll (23), and the driving rollers (20, 21) are arranged in an S-configuration so that the support roll (23) can revolve slower than the drive rollers (20, 21).

17. A hands-free paper towel dispensing system, comprising:

a unit of consumable articles comprising a pile (5) of a continuous length of accordion-like folded web of towels of tissue paper or nonwoven material web comprising bundles (6), and means for connecting (7) between the bundles (6);

a dispensing unit (1) comprising an outer front wall (2), two outer side walls (3), a top, and a housing (4) for holding said pile (5), said outer front wall (2) having an access opening (8) and a dispensing opening (9) for the web of towels, a feeding mechanism (10) comprising a member for controlling, by sending signals, the dispensing (11) of the web of towels from the upper part of the pile (5), the member for controlling including a microprocessor and at least one sensor unit, a drive unit (16), the drive unit (16) including two drive rollers (20, 21), and a braking arrangement (12) for the web of towels, the braking arrangement located at a web position upstream of the drive unit, the braking arrangement being configured so as not to allow the web of towels to go backward during normal operation, the braking arrangement including a nip for the paper web with a rubber covered roll (19) and a rod (24) to lock the web of towels against the rubber covered roll (19) when pulling backwards the rod being pivotable about an axis spaced from the rod, such that the rod presses against a downstream side of the rubber covered roll;

the unit of consumable articles being located within the dispensing unit (1) and inserted through the access opening (8) into the housing (4) for holding the unit of consumable articles as the bundles (6) of a continuous length of accordion-like folded web of towels of tissue paper or nonwoven material web is added to the bottom of the pile (5), the unit of consumable articles being further connected by the web of towels from the upper part of the pile (5) to the dispensing unit via the braking arrangement (12) and out through the dispensing opening (9), whereas the feeding mechanism (10) automatically positions the web of towels in a starting mode (13) in the dispensing opening (9).

18. The hands-free paper towel dispensing system according to claim 17, wherein the placement of the feeding mechanism (10) is situated in vertical alignment with the pile (5) of web of towels.

19. The hands-free paper towel dispensing system according to claim 18, wherein the feeding mechanism (10) is arranged to go in a non operative mode when the access opening (8) is opened.

20. The hands-free paper towel dispensing system according to claim 18, wherein the member for controlling the dispensing (11) of the web of towels from the upper part of the pile (5) does not allow the last towels of the web of towels to be dispensed.

21. The hands-free paper towel dispensing system according to claim 20, wherein the member for controlling the dispensing (11) of the web of towels comprises a first sensor unit (14) comprising at least one sensor located at the side or sides of the pile (5) of web of towels, said first sensor unit (14) allowing the member for controlling the dispensing (11) to be in an operative mode as long as the web of towels are detected by the first sensor unit (14).

22. The hands-free paper towel dispensing system according to claim 21, wherein the first sensor unit (14) is arranged to transmit a signal that can be used to measure any interruption of the continuous web of towels passing through from the pile (5) of the web of towels to the feeding mechanism (10).

23. The hands-free paper towel dispensing system according to claim 21, further comprising an indicator arranged to be activated when the first sensor unit (14) signals that the dispenser is empty as the interruption of the continuous web of towels passing through from the pile (5) of the web of towels to the feeding mechanism (10) is measured.

24. The hands-free paper towel dispensing system according to claim 21, further comprising a second sensor unit (22) below the first sensor unit (14), arranged to measure and detect that the pile of the web of towels is at a low level and will thereby send signals to a warning system.

25. The hands-free paper towel dispensing system according to claim 18, wherein the means for connecting (7) between the bundles (6) comprise glue or an adhesive or pressure sensitive tape.

26. The hands-free paper towel dispensing system according to claim 18, wherein the at least one sensor unit comprises a starting sensor (15) arranged to sense the presence of a user, and to activate the feeding mechanism (10), which automatically will initiate the dispensing of the web of towels to a hands-free position.

27. The hands-free paper towel dispensing system according to claim 26, wherein the starting sensor (15) has an operating range of not more than 30 cm.

28. The hands-free paper towel dispensing system according to claim 18, wherein the length of the web of towels presented in the hands-free position is from about 15 to about 50 cm.

29. The hands-free paper towel dispensing system according to claim 18, wherein the width of the side walls (3) is not more than 10 cm and the accordion-like folded towels preferably have a panel width (16) of not more than 10 cm.

30. The hands-free paper towel dispensing system according to claim 18, wherein the feeding mechanism (10) is arranged to allow the position of the web of towels in the dispensing opening (9) to remain unchanged in the starting mode (13) during refill.

31. The hands-free paper towel dispensing system according to claim 17, wherein the placement of the feeding mechanism (10) is situated in vertical alignment below the pile (5) of web of towels.

32. The hands-free paper towel dispenser according to claim 17, wherein the feeding mechanism (10) includes a tearing edge configured to tear a dispensed paper towel.

33. The hands-free paper towel dispenser according to claim 17, wherein the at least one sensor unit comprises at least one sensor at a side or sides of the pile (5) of the web of towels, the at least one sensor unit being configured to sense a last towel of the web of towels or an interruption of the web of towels.

34. The hands-free paper towel dispenser according to claim 17, wherein the feeding mechanism (10) includes a support roll (23), the support roll (23) including a cutting or perforation integrated into the support roll (23), and the driving rollers (20, 21) are arranged in an S-configuration so that the support roll (23) can revolve slower than the drive rollers (20, 21).

35. A hands-free paper towel dispensing system, comprising:

a unit of consumable articles comprising a pile (5) of a continuous length of accordion-like folded web of towels of tissue paper or nonwoven material web comprising bundles (6), and means for connecting (7) between the bundles (6);

a dispensing unit (1) comprising an outer front wall (2), two outer side walls (3), a top, and a housing (4) for holding said pile (5), said outer front wall (2) having an access opening (8) a dispensing opening (9) for the web of towels, and a feeding mechanism (10) comprising a member for controlling, by sending signals, the dispensing (11) of the web of towels from the upper part of the pile (5) the member for controlling including a microprocessor, a first sensor unit and a second sensor unit, the first sensor unit comprising a starting sensor (15) arranged to sense the presence of a user, and to activate the feeding mechanism (10), which automatically will initiate the dispensing of the web of towels to a hands-free position, the second sensor unit comprising at least one sensor at a side or sides of the pile (5) of the web of towels, the second sensor unit being configured to sense a last towel of the web of towels or an interruption of the web of towels, a drive unit (16), the drive unit (16) including two drive rollers (20, 21), and a braking arrangement (12) for the web of towels, the braking arrangement located at a web position upstream of the drive unit, the braking arrangement being configured so as not to allow the web of towels to go backward during normal operation, the braking arrangement including a nip for the paper web with a rubber covered roll (19) and a rod (24) to lock the web of towels against the rubber covered roll (19) when pulling backwards the rod being pivotable about an axis spaced from the rod, such that the rod presses against a downstream side of the rubber covered roll;

the unit of consumable articles being located within the dispensing unit (1) and inserted through the access opening (8) into the housing (4) for holding the unit of consumable articles as the bundles (6) of a continuous length of accordion-like folded web of towels of tissue paper or nonwoven material web is added to the bottom of the pile (5), the unit of consumable articles being further connected by the web of towels from the upper part of the pile (5) to the dispensing unit via the braking arrangement (12) and out through the dispensing opening (9), whereas the feeding mechanism (10) automatically positions the web of towels in a starting mode (13) in the dispensing opening (9).

* * * * *